US006502954B1

(12) United States Patent
Demkowski

(10) Patent No.: US 6,502,954 B1
(45) Date of Patent: Jan. 7, 2003

(54) LAMP ATTACHMENT FOR FLASHLIGHT

(76) Inventor: Michael J. Demkowski, 2706 N. 60th St., Omaha, NE (US) 68104

( * ) Notice: Subject to any disclaimer, the term of this patent is extended or adjusted under 35 U.S.C. 154(b) by 0 days.

(21) Appl. No.: 09/501,427

(22) Filed: Feb. 10, 2000

(51) Int. Cl.[7] ..... F21L 4/04
(52) U.S. Cl. ..... 362/198; 362/102; 362/186
(58) Field of Search ..... 362/186, 202, 362/102, 363, 166, 198

(56) References Cited

U.S. PATENT DOCUMENTS 4,141,157 A * 2/1979 Maldacker ..... 434/286
4,733,337 A * 3/1988 Bieberstein ..... 362/157
4,888,670 A * 12/1989 Sharrah ..... 362/205
4,989,123 A * 1/1991 Best ..... 362/102
5,037,346 A * 8/1991 Cimock ..... 362/806
5,957,566 A * 9/1999 Chiu ..... 362/190
6,158,871 A * 12/2000 Goddes et al. ..... 362/118

* cited by examiner

*Primary Examiner*—Sandra O'Shea
*Assistant Examiner*—John Anthony Ward

(57) ABSTRACT

A lamp attachment for a flashlight includes a hollow bulb for transmitting light, the bulb having an open end,mounted on a hollow base. The base is interiorly threaded for attachment to the threaded end of a flashlight with the lens attachment removed from the flashlight housing. The lighting element of the flashlight projects within the bulb to provide used light like a lamp.

8 Claims, 2 Drawing Sheets

LAMP ATTACHMENT FOR FLASHLIGHT

CROSS-REFERENCES TO RELATED APPLICATIONS (Not applicable)

STATEMENT AS TO RIGHTS TO INVENTIONS MADE UNDER FEDERALLY SPONSORED RESEARCH AND DEVELOPMENT (Not applicable)

BACKGROUND OF THE INVENTION (1) Field of the Invention

The present invention relates generally to flashlights, and more particularly to an attachment for a flashlight which permits use of the flashlight which permits use of the flashlight as a lamp with wide spread dispersion of the light.

(2) Background Information

Backpacking and camping is a popular pastime for many people. Of the many accessory items available for these endeavors, apparatus for providing a small, lightweight lamp for use within a tent has long been a difficult endeavor for this industry. Various types of gas lanterns have been available for many years, but because of the heat produced and the flame utilized in the lamp, are not necessarily a safe apparatus for use within the confines of a tent. This is especially true for small tents utilized in backpacking or the like, wherein the space within the tent is extremely limited, and a lantern cannot be easily supported or safely operated.

Another problem with conventional lanterns is there large size and heavy weight. While the light provided is excellent, the typical backpacker will not carry such an apparatus because of the size and weight.

Battery operated lanterns are also available in the camping industry. However, these lanterns are also quite heavy, especially when operated with conventional lantern batteries, and are also typically quite bulky.

BRIEF SUMMARY OF THE INVENTION

It is therefore a general object of the present invention to provide an attachment for a flashlight which permits use of the flashlight as a reading lamp.

Another object of the present invention is to provide an improved flashlight attachment which will readily attach to conventional flashlights already in use by a camper.

Yet another object of the present invention is to provide an improved attachment for flashlights which is simple to manufacture, refined in appearance, and easy to use.

These and other objects of the present invention will be apparent to those skilled in the art.

The lamp attachment for a flashlight of the present invention includes a hollow bulb for transmitting light, the bulb having an open end mounted on a hollow base. The base is interiorly threaded for attachment to the threaded end of a flashlight with the lens attachment removed from the flashlight housing. The lighting element of the flashlight projects within the bulb to provide a diffused light like a lamp.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 1:
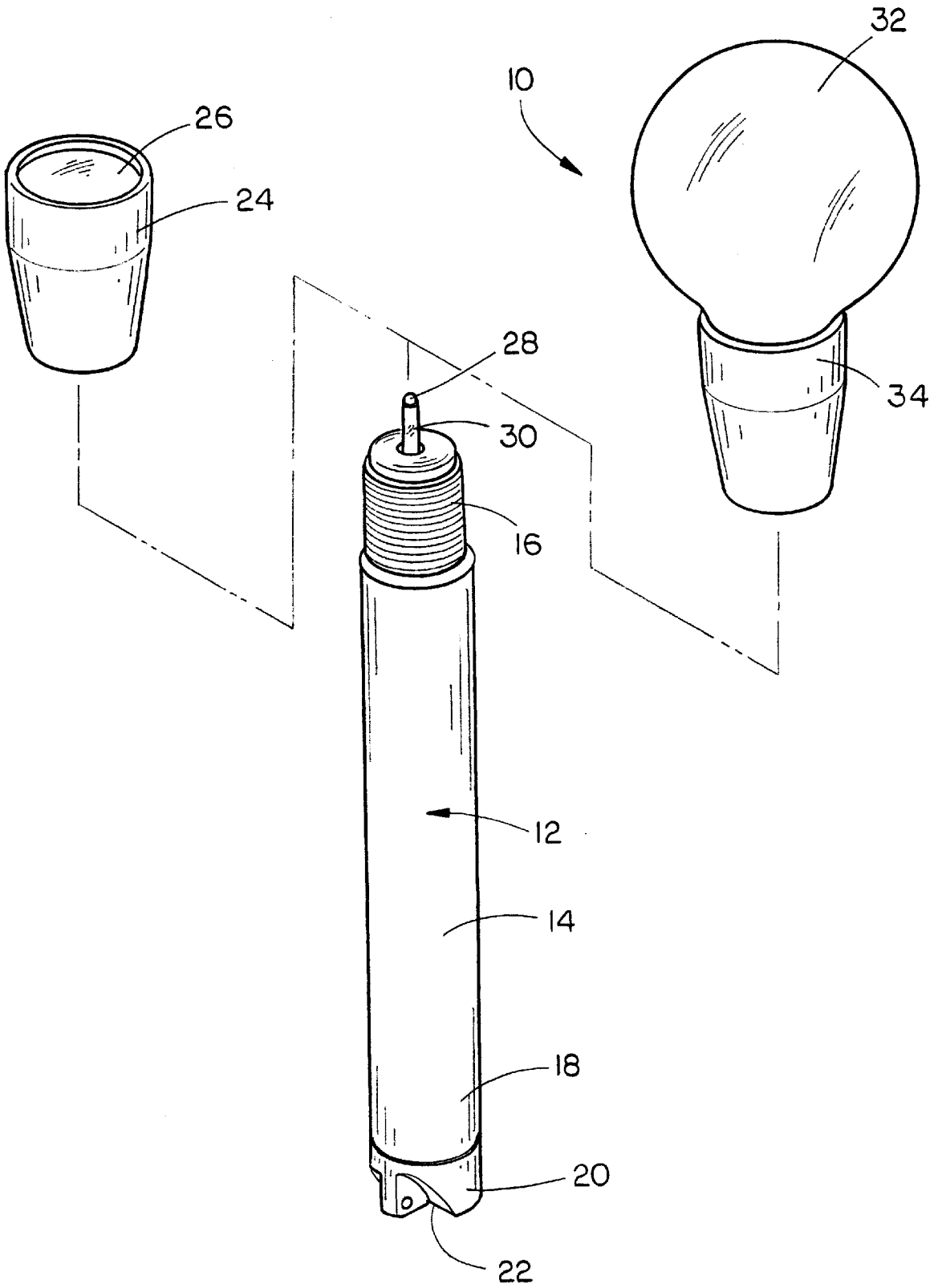
FIG. 1 is an exploded perspective view of a flashlight with a conventional lens and the lamp attachment of the present invention.

Referring now to the drawings, more particularly to FIG. 1, the lamp attachment of the present invention is designated generally at 10 and is shown associated with a conventional lightweight portable flashlight 12. Flashlight 12 includes a generally cylindrical housing 14 having opposing forward and rearward ends 16 and 18.

A cap 20 is removably mounted on the rearward end of flashlight housing 14, and will permit access to the interior of the housing for the introduction of a power source, such as batteries, to power the flashlight. Preferably, cap 20 has a flat bottom 22 which would permit the flashlight to stand upright on a flat surface. The forward end 16 of housing 14 is exteriorly threaded to receive an interiorly threaded lens attachment 24, having a lens 26 in the forward end thereof for focusing light from lighting element 28.

As shown in FIG. 1, lighting element 28 is positioned spaced outwardly from the forward end of housing forward end 16, on a support 30. While not all flashlights have lighting element 28 positioned in this fashion, the preferred embodiment of the invention includes this feature.

Flashlight 12 may be activated in any common fashion, with an annually activated switch, or by rotation of lens attachment 24 on the threaded end 16 of housing 14.

Lamp attachment 10 of the present invention includes a generally spherical bulb 32 which is coated with a translucent material to uniformly diffuse light. Although bulb 32 may be transparent, a translucent, diffused light is preferable for use as a lamp. Bulb 32 is preferably a hollow spherical enclosure with an open lower end affixed to a hollow cylindrical base 34. Base 34 is interiorly threaded to engage the threaded end 16 of housing 14 to secure lamp attachment 10 to flashlight housing 14. Preferably, base 34 is substantially similar in shape and size to lens attachment 24, such that lighting element 28 projects into the interior of bulb 32 when lamp attachment 34 is secured on flashlight housing 14.

Once activated, light element 28 within bulb 32 produces a widely dispersed light which has been found to be sufficient for reading and the like in small dark enclosures, such as backpackers'tents. The light produced by lamp attachment 32 is greatly preferred to the direct focused light of flashlight 12 with lens attachment 24. Because flashlight 12 may be of a small pen light type size, it is easily transported and stored, and is light in weight. In addition, the lighting element 28 is spaced within bulb 32 so as to produce a uniformly dispersed light which does not create significant amount of heat in bulb 32.

Figure 2:
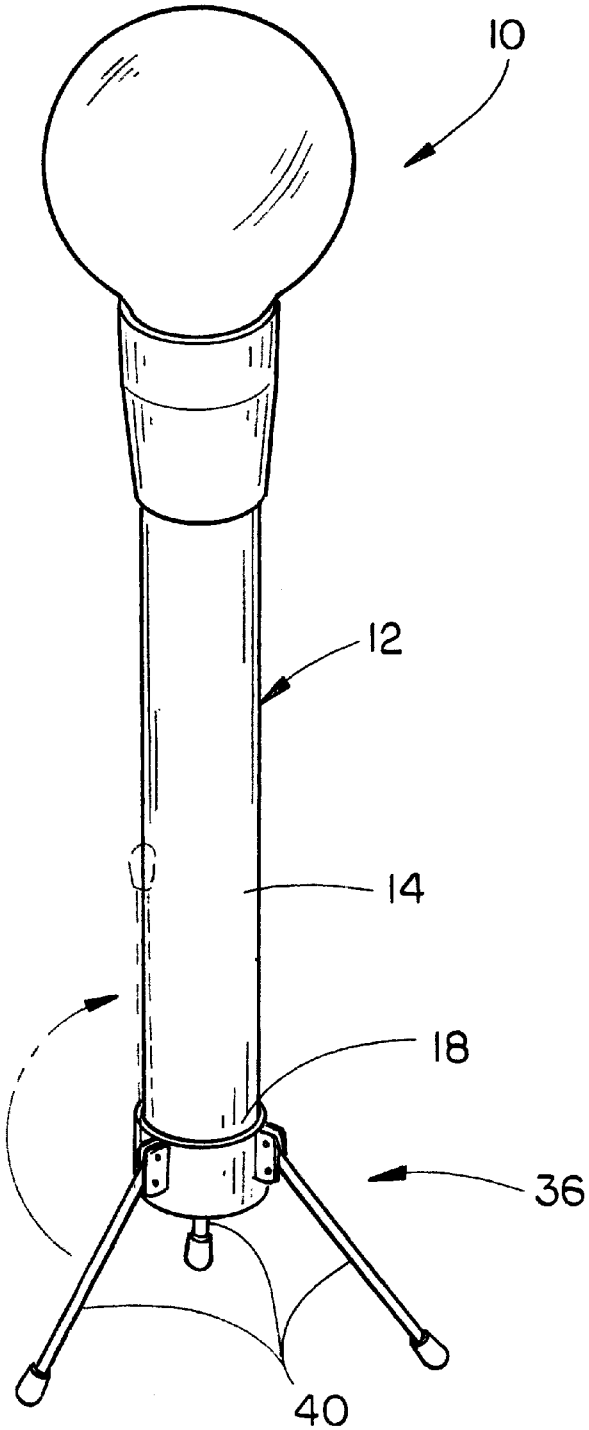
FIG. 2 is a perspective view of the lamp attachment of the present invention installed on a flashlight.

Referring now to FIG. 2, lamp attachment 10 is shown attached to flashlight 12 on the forward end of housing 14. In addition, a collapsible stand 36 is shown connected to the rearward end 18 of housing 14. Stand 36 includes a cylindrical shaped hub 38 within which the lower end of flashlight housing 14 may be journaled for support, and a plurality of legs 40 pivotally connected to hub 38. Legs 40 may be folded to the broken line position shown in FIG. 2, adjacent the sides of flashlight housing 14 during transport, and may then be folded down to form a tripod supporting the flashlight in a vertically oriented position. Stand 36 is shown to describe one possibility of a stand for supporting the flashlight in a position oriented for use as a lamp, but does not intended to foreclose other equivalent and similar methods of accomplishing this goal.

Figure 3:
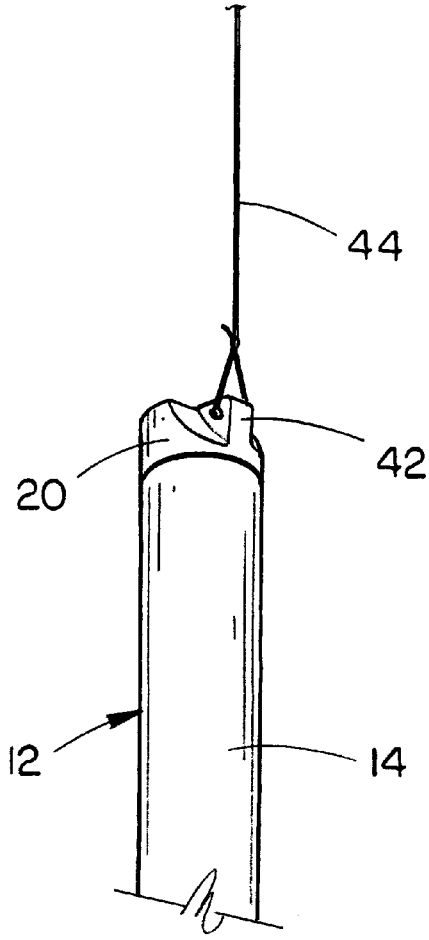
FIG. 3 is a perspective view of the inverted end of the flashlight showing use of the flashlight as a hanging lantern.

Referring now to FIG. 3, flashlight housing 14 is shown inverted with cap 20 oriented upwardly. The key ring flange 42 is used to thread a support string 44 so that the flashlight may be suspended from a tent roof, or the like, much as a lightbulb is suspended from a ceiling. Because of the light weight of the flashlight 12, the lamp attachment 10 may be utilized in tents of very small dimensions without concern for tearing the tent fabric.

Whereas the invention has been shown and described in connection with the preferred embodiment thereof, many modifications, substitutions and additions may be made which are within the intended broad scope of the appended claims.

I claim:

1. In combination:

a flashlight having an elongated cylindrical housing with forward and rearward ends;

a lighting element connected to the forward end of the housing and selectively connected to a power source;

said lighting element being mounted on a support extending outwardly from the forward end of the housing, such that the lighting element is spaced from the housing forward end;

a first interchangeable attachment including a generally disk-shaped lens mounted on a base, said base having means for removably attaching the lens to the housing forward end to enclose the lighting element within the attachment;

a second interchangeable attachment including a generally spherical hollow bulb mounted on a base, the base having means for removably attaching the bulb to the housing forward end to enclose the lighting element within the attachment; and a support stand removably connected to the rearward end of said housing for supporting the housing on the ground in a generally upright orientation;

said support stand including a plurality of independently collapsible legs, each leg operable between a first position collapsed against the housing, and a second position projecting from the housing;

said lighting element support extending outwardly a distance such that said lighting element is located generally centrally within said bulb of the second interchangeable attachment, when the second attachment is connected to the housing forward end.

2. The combination of claim 1, wherein said bulb is clear.

3. The combination of claim 1, wherein said bulb is translucent, to diffuse light from the lighting element.

4. The combination of claim 1, wherein said bulb is clear.

5. The combination of claim 1, wherein said bulb is translucent, to diffuse light from the lighting element.

6. The combination of claim 1, wherein said means for removably attaching the bulb to the housing includes means for locating the bulb such that the lighting element is located within the bulb when the second attachment is attached to the housing.

7. The combination of claim 1, wherein the power source is at least one battery within the housing.

8. The combination of claim 1, wherein said means for removably attaching the lens and the bulb to the housing includes:

said housing forward end being exteriorly threaded;

said first attachment base being interiorly threaded for connection to the housing threads; and said second attachment being interiorly threaded for connection to the housing threads.

* * * * *